US009211893B2

(12) United States Patent
Ait-Jeddi et al.

(10) Patent No.: US 9,211,893 B2
(45) Date of Patent: Dec. 15, 2015

(54) SANITARY MODULE FOR RAIL VEHICLES

(71) Applicant: SIEMENS AKTIENGESELLSCHAFT, Munich (DE)

(72) Inventors: Abdessamad Ait-Jeddi, Dorsten (DE); Walter Lindermuth, Nieukerk (DE)

(73) Assignee: Siemens Aktiengesellschaft, Munich (DE)

( * ) Notice: Subject to any disclaimer, the term of this patent is extended or adjusted under 35 U.S.C. 154(b) by 21 days.

(21) Appl. No.: 14/360,710

(22) PCT Filed: Sep. 26, 2012

(86) PCT No.: PCT/EP2012/068941

§ 371 (c)(1),
(2) Date: May 27, 2014

(87) PCT Pub. No.: WO2013/075866

PCT Pub. Date: May 30, 2013

(65) Prior Publication Data

US 2015/0166080 A1 Jun. 18, 2015

(30) Foreign Application Priority Data

Nov. 24, 2011 (DE) ..... 10 2011 087 018

(51) Int. Cl.

| | |
|---|---|
| ***B61D 17/00*** | (2006.01) |
| ***B61D 17/04*** | (2006.01) |
| ***B61D 35/00*** | (2006.01) |
| ***B61D 17/10*** | (2006.01) |

(52) U.S. Cl.

CPC ..... *B61D 17/043* (2013.01); *B61D 17/10* (2013.01); *B61D 35/00* (2013.01)

(58) Field of Classification Search

CPC ..... B61D 17/043; B61D 17/10; B61D 17/08; E03D 11/12

See application file for complete search history.

(56) References Cited

U.S. PATENT DOCUMENTS

| | | | | |
|---|---|---|---|---|
| 2,076,950 | A * | 4/1937 | Koch | 4/312 |
| 2,725,575 | A * | 12/1955 | Colonna | 4/312 |
| 2,826,762 | A * | 3/1958 | Colonna | 4/312 |
| 2009/0255437 | A1 * | 10/2009 | Hachet et al. | 105/344 |
| 2010/0229293 | A1 * | 9/2010 | Rodgers et al. | 4/246.1 |
| 2015/0166080 | A1 * | 6/2015 | Ait-Jeddi et al. | 105/422 |

FOREIGN PATENT DOCUMENTS

| | | | | |
|---|---|---|---|---|
| DE | 284848 | A5 | 11/1990 | |
| DE | 102009029954 | A1 | 12/2010 | |
| EP | 2266858 | A2 * | 12/2010 | B61D 35/00 |
| EP | 2266858 | B1 | 5/2013 | |
| GB | 191310131 | A | 0/1913 | |

* cited by examiner

*Primary Examiner* — Jason C Smith
(74) *Attorney, Agent, or Firm* — Laurence Greenberg; Werner Stemer; Ralph Locher

(57) ABSTRACT

A sanitary module for a rail vehicle has a trough-shaped floor region and side panels. The side panels have on their inside a recess in the floor region, in the cross-section of which ramp-like sealing profile sections are provided, the vertically running side areas of which are in contact with associated recess areas of the side panels. The sealing profiles are formed for fastening onto a baseplate. A floor covering forms the trough-shaped floor region of the sanitary module and extends across the ramp-like sides of the covering profiles. Sealing material is introduced in the upper part of the recess of the side panels in such a manner that the floor covering is closed flush with the side panels above the recess thereof.

7 Claims, 2 Drawing Sheets

SANITARY MODULE FOR RAIL VEHICLES

BACKGROUND OF THE INVENTION

1. Field of the Invention

The invention relates to a sanitary module for rail vehicles, having a tub-shaped floor region and side walls.

Such sanitary modules are in wide use. In one example, a tub which is made of glass-fiber reinforced plastic and which has a heightened collar is adhesively bonded to a supporting floor in the floor region. Side walls of the sanitary module are then fastened to the collar of the tub made of glass-fiber reinforced plastic. This solution is employed, for example, in the case of the wet cells for the Scot Rail project and in the case of the wet cells for the Desiro UK West Midland Franchise (WMF) projects.

The known solution requires the employment of a prefabricated tub made of glass-fiber reinforced plastic, which is not always easy to align. Moreover, assembly of the side walls on the heightened collar is complex.

2. Brief Summary of the Invention

Proceeding therefrom, the invention is based on the object of providing a sanitary module which has a closed, tight floor tub and which is easy to manufacture.

This object is achieved in that the side walls, on their insides, have a recess in the floor region, sealing profile portions, which are ramp-shaped in their cross section and the vertically running side faces of which bear on assigned recess faces of the side walls, are provided, the sealing profiles are configured for fastening to a floor panel, a floor covering configures the tub-shaped floor region of the sanitary module and extends across the ramp-shaped sides of the covering profiles, and sealing material is introduced into the upper part of the recess of the side walls in such a manner that the floor covering terminates flush with the side walls above the recess of the latter.

This design of the sanitary module allows for all required sealing profiles according to a sanitary-module floor plan to be arranged by means of a template and for a position of the individual sealing profiles to be marked in each case. All prepared sealing profiles are then fastened on a floor panel, specifically corresponding to the floor plan of the sanitary module.

In contrast to the prior art discussed above, the floor region is not formed by a prefabricated tub. Rather, a floor covering, which on account of the recesses provided in the side walls of the sanitary module can be terminated so as to be flush with the side walls, is employed for configuring the floor-side tub. In this manner, a tight, closed floor tub, specifically having a low investment in assembly, is manufactured within the sanitary module.

The side walls are preferably supported on panel-shaped portions of the sealing profiles which, in the horizontal direction toward the outside, adjoin the ramp-shaped portions of said sealing profiles, and said side walls are configured for fastening on the floor panel. This allows for a simple connection between the side walls and the floor panel, such that a low investment in assembly is achieved here, too.

Grooves for receiving adhesive may be provided on a lower side of the ramp-shaped portion of the sealing profiles. This allows for the aligned sealing profiles to be adhesively bonded to the floor in a simple manner.

In one embodiment, the side walls may be manufactured from glass-fiber reinforced plastic. Alternatively, it is also possible for the side walls to be present in the form of sandwich walls. In the last-mentioned embodiment it may be provided that insides of the side walls are formed by panels, the lower end portion of which is, vertically offset, adhesively bonded laterally to a rectangular bar, the lower end portion of which bears on the vertically running side faces of the ramp-shaped sealing profile portions.

On account of the panels being adhesively bonded in a vertically offset manner in relation to the rectangular bars, a recess similar to the one in the GRP side walls results, where the recess in the latter can already be provided during production.

Exemplary embodiments of the invention are explained in even more detail in the following with reference to the drawing, in which:

The covering profiles are preferably fastenable on the floor panel by means of fixing battens.

DESCRIPTION OF THE INVENTION

Figure 1:
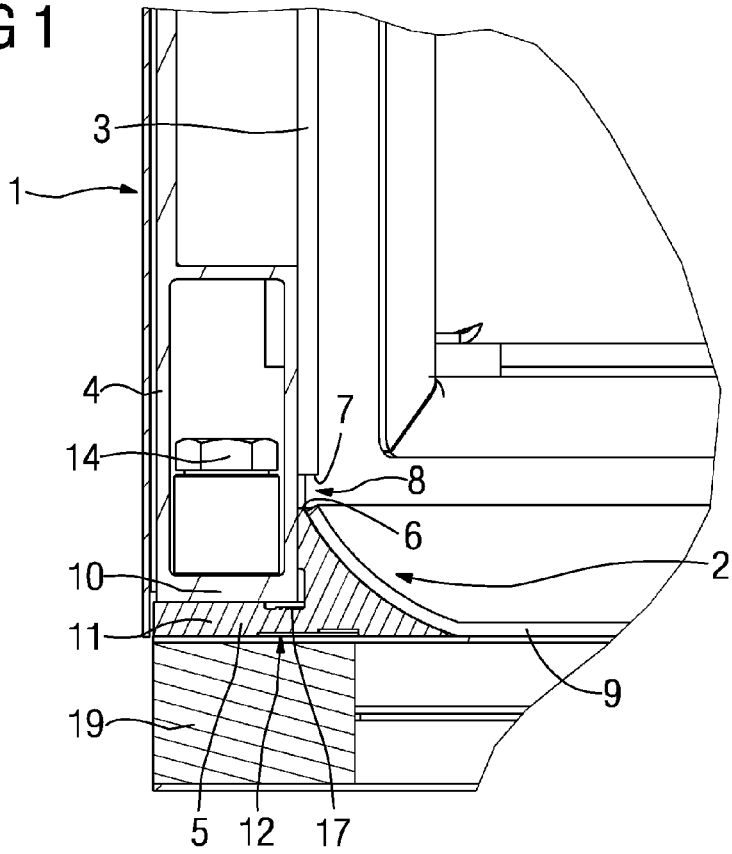
FIG. 1 shows a sectional view of a lower corner region of a sanitary module in a first embodiment.

FIG. 1 shows a lower corner region of a sanitary module, the side walls of which are present in the form of sandwich walls. The lower portion of a side wall 1, illustrated in FIG. 1, shows a recess 2 in the base region of the former. This recess 2 results from a panel 3, which is arranged on the inside and runs vertically and which configures the inside of the side wall 1, being adhesively bonded in a vertically offset manner to a rectangular bar 4. In this manner, a lower portion of the side face of the rectangular bar 4 remains clear of the panel 3, such that the recess 2 results here.

In the region of the recess 2, an inside portion of the rectangular bar 4 bears on a vertical side portion of a covering profile 5 which runs in a ramp-shaped manner from its vertical side portion toward the inside of the sanitary module. With respect to its vertical extent along the rectangular bar 4, the covering profile 5 here is dimensioned such that a gap 8 remains between an upper edge 6 of the covering profile 5 and a lower edge 7 of the panel 3. Additionally, the covering profile 5 is adhesively bonded at 17 in the region of the lower, inner edge of the side wall 1.

A tub-shaped floor region of the sanitary module is formed by a floor covering 9 which extends in the direction toward the side wall 1 across the ramp-shaped portion of the covering profile 5. The floor covering 9 terminates approximately at the height of the upper edge 6 of the covering profile 5. Here, a thickness of the combination consisting of the covering profile 5 and the floor covering 9 in the region of the upper edge 6 substantially corresponds to the thickness of the panel 3. By way of filling the gap 8 with a sealing material, it is possible to implement a flush termination of the floor covering 9 on the panel 3 in this manner.

A base 10 of the side wall 1 is supported on a panel-shaped portion 11 of the covering profile 5. On its lower side, the covering profile 5 displays grooves 12 for adhesive, by means of which a lower side of the covering profile 5 is adhesively bonded to a floor panel 13. If required, the covering profile 5 may additionally be screwed to the floor panel 13 at a number of points.

The base 10 is attached to the floor panel 13 by means of a screw connection 14 which reaches through the panel-shaped portion 11 of the covering profile 5.

Figure 2:
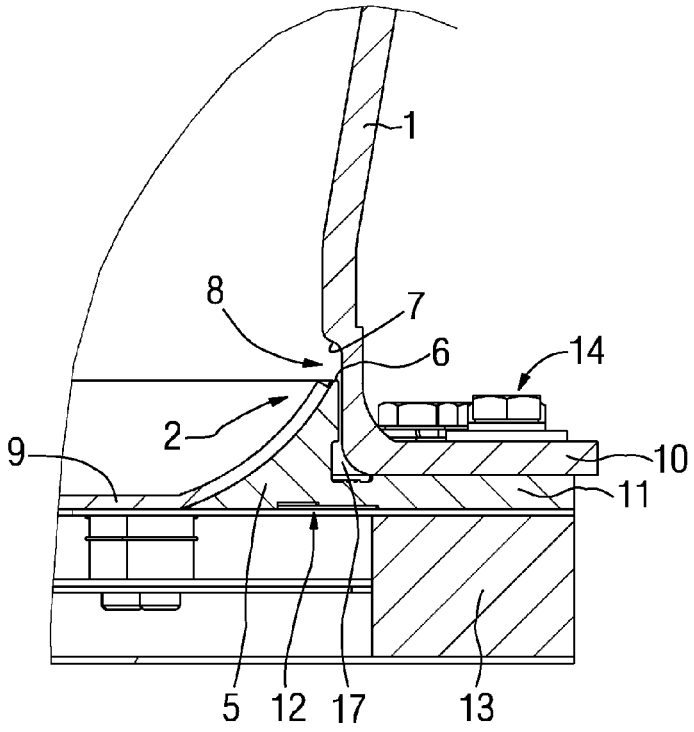
FIG. 2 shows a sectional view of a lower corner region of a sanitary module in a second embodiment.

FIG. 2 relates to an embodiment of a sanitary module which is equipped with side walls made of glass-fiber reinforced plastic. Here, components in FIG. 2 are identified with the same reference numbers as functionally identical components illustrated in FIG. 1. The substantial difference in the design of the sanitary module is the type of the side wall. A side wall 1 made of GRP material, in its base region, shows a generally L-shaped cross section. A recess 2 is provided in the base region 10 already during production of the side wall 1, in the region of which recess 2, in turn, a covering profile 5 bears with its vertical side face. A floor covering 9 extends from the inside of the sanitary module beyond a ramp-shaped portion of the covering profile 5 and terminates at the height of an upper edge 6 of the covering profile 5, in the region of the recess 2. As with the embodiment as per FIG. 1, a gap 8 for receiving sealing material is kept clear, by means of which a flush connection of the floor covering 9 to the side wall 1 can be achieved on the inside of the latter.

For the purposes of fastening, the base 10 of the side wall 1 is connected to the floor panel 13 with screw connections 14 which reach through a panel-shaped portion 11 of the covering profile 5. The covering profile 5 is adhesively bonded to the floor panel 13 by means of grooves 12.

Irrespective of whether the side walls are present in the form of glass-fiber reinforced plastic or sandwich walls, sanitary modules for rail vehicles can be constructed in a simple manner: initially the covering profiles 5, corresponding to a previously known floor plan of the sanitary module, are adhesively bonded to the floor panel 13 by way of the grooves 12. Subsequently, the side walls 1 are assembled by means of the screw connections 14, and, in order to configure a tub shape, the floor covering 9 is introduced into the floor region. In order to seal the tub-shaped floor region, which is configured by the floor 9, the gap 8 is filled with sealing means, such that a moisture-proof connection of the floor covering 9 to the side wall 1 is achieved.

Figure 3:
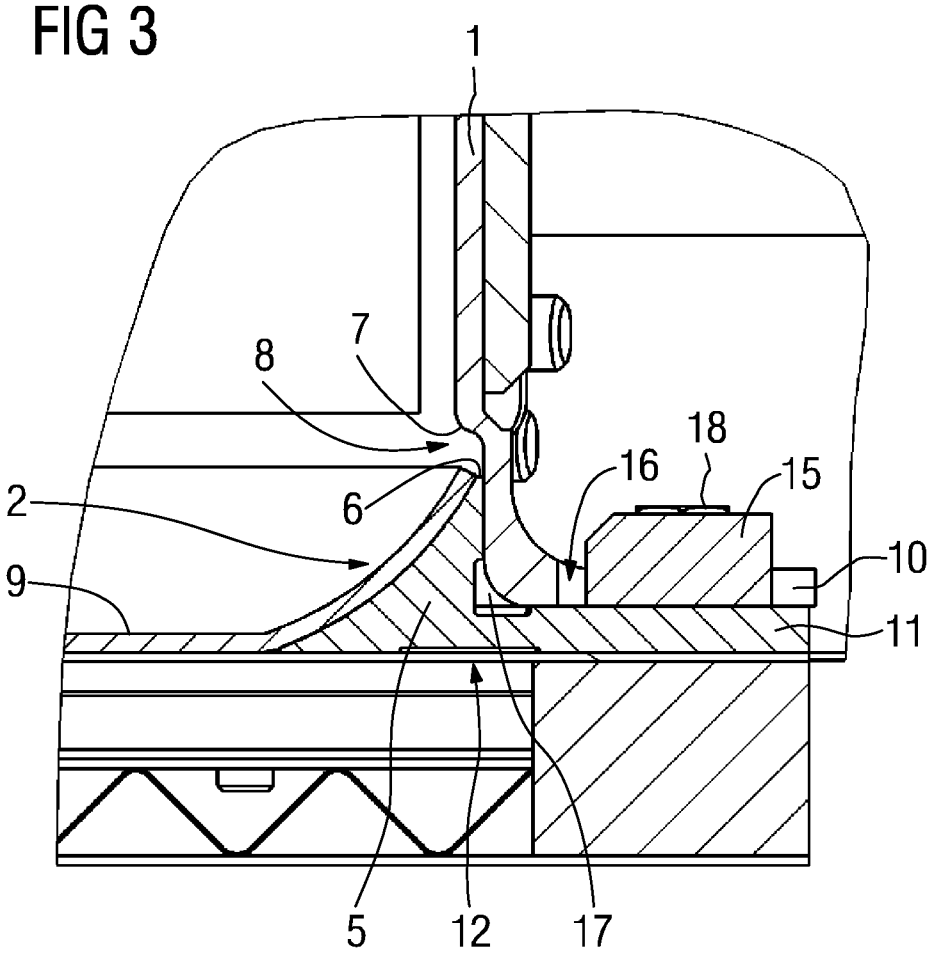
FIG. 3 shows a sectional view of a lower corner region of a sanitary module in a third embodiment.

The embodiment visualized by means of FIG. 3 differs from that of FIG. 2 in that the covering profile 5, by way of its panel-shaped portion 11, is fixed in a different manner. In this context, the base 10 of the side wall 1 shows a cutout into which a fixing batten 15 is inserted. The fixing batten 15 is fastened to the floor panel 13 by means of a screw connection 18. Here, a gap between the fixing batten 15 and the adjoining, vertical end side of the side wall 1 is provided with adhesive. The variant of the embodiment illustrated in FIG. 3 relates to an installation situation for the sanitary module which is different from that of FIG. 2.

The invention claimed is:

1. A sanitary module for a rail vehicle, comprising:

a floor formed with a floor panel and side walls laterally bounding said floor;

said side walls having recesses formed on an inside thereof in a vicinity of said floor;

sealing profiles having a cross-section with a ramp-shaped side and vertically running side faces, said vertically running side faces bearing against recess faces in said recesses of said side walls, said sealing profiles being configured for fastening to said floor panel;

a floor covering extending across said ramp-shaped sides of said sealing profiles and forming a tub-shaped floor region of the sanitary module; and sealing material introduced into an upper part of said recesses of said side walls such that said floor covering terminates flush with said side walls above said recesses.

2. The sanitary module according to claim 1, wherein said sealing profiles are formed with panel-shaped portions supporting said side walls, said panel-shaped portions projecting horizontally outward and adjoining said ramp-shaped portions of said sealing profiles, and said side walls are configured for fastening on said floor panel.

3. The sanitary module according to claim 1, wherein said ramp-shaped portion of said sealing profiles has lower sides formed with grooves for receiving adhesive.

4. The sanitary module according to claim 1, wherein said side walls are formed of glass-fiber reinforced plastic.

5. The sanitary module according to claim 1, wherein said side walls are sandwich walls.

6. The sanitary module according to claim 5, wherein said sandwich walls have insides formed by panels, said panels have a lower end portion that is vertically offset and adhesively bonded laterally to a rectangular bar, and a lower end portion of said rectangular bar bears on said vertically running side faces of said ramp-shaped sealing profile portions.

7. The sanitary module according to claim 1, wherein said sealing profiles are fastened by a fixing batten configured for interaction with said floor panel.

* * * * *